US006669539B1

(12) United States Patent
Amartur

(10) Patent No.: US 6,669,539 B1
(45) Date of Patent: Dec. 30, 2003

(54) SYSTEM FOR IN-SITU MONITORING OF REMOVAL RATE/THICKNESS OF TOP LAYER DURING PLANARIZATION

(75) Inventor: Sundar Amartur, Fremont, CA (US)

(73) Assignee: Lam Research Corporation, Fremont, CA (US)

( * ) Notice: Subject to any disclaimer, the term of this patent is extended or adjusted under 35 U.S.C. 154(b) by 64 days.

(21) Appl. No.: 10/002,575

(22) Filed: Nov. 14, 2001

(51) Int. Cl.[7] ..... B24B 1/00

(52) U.S. Cl. ..... 451/57; 451/6; 451/8; 451/10; 451/41; 451/286; 451/287

(58) Field of Search ..... 451/6, 8, 10, 41, 451/57, 286, 287

(56) References Cited

U.S. PATENT DOCUMENTS 5,433,651 A * 7/1995 Lustig et al. ..... 451/6
6,111,634 A * 8/2000 Pecen et al. ..... 356/72
6,261,851 B1 * 7/2001 Li et al. ..... 438/8

* cited by examiner

*Primary Examiner*—Joseph J. Hail, III
*Assistant Examiner*—Shantese McDonald
(74) *Attorney, Agent, or Firm*—Martine & Penilla, LLP

(57) ABSTRACT

An invention is provided for removing a top wafer layer during a CMP process. Time series data is collected based on a reflected wavelength from a top layer of a wafer. A Fourier Transform is applied to the time series data, and a frequency of peak intensities in the Fourier Transform of the time series data is analyzed to determine a peak magnitude in the frequency. A first removal rate of the top layer is determined based on the peak magnitude in the frequency, and a current thickness of top layer is calculated based on the first removal rate. The CMP process is discontinued when the current thickness of the top layer is equal to or less than a target thickness, and a separate polishing process is performed to remove an additional portion of the top layer. In one aspect, the separate polishing process can be based on a soft endpoint detection process having second removal rate that is lower than the first removal rate.

18 Claims, 10 Drawing Sheets

SYSTEM FOR IN-SITU MONITORING OF REMOVAL RATE/THICKNESS OF TOP LAYER DURING PLANARIZATION

BACKGROUND OF THE INVENTION

1. Field of the Invention

This invention relates generally to planarization in a chemical mechanical polishing process, and more particularly to in-situ monitoring of removal rate and thickness of a top layer during planarization.

2. Description of the Related Art

The semiconductor industry is continually striving to improve the performance of semiconductor devices, while still attempting to reduce the cost of these same devices. These objectives have been successfully addressed by the ability of the semiconductor industry to practice micro-miniaturization, or to fabricate semiconductor devices with sub-micron features. Several fabrication disciplines, such as photolithography, as well as dry etching, have allowed micro-miniaturization to be realized. The use of more sophisticated exposure cameras, as well as the use of more sensitive photoresist films, have allowed the attainment of sub-micron images in photoresist films, to be routinely achieved. In addition, the development of more advanced dry etching tools and processes, have allowed the sub-micron images, in masking photoresist films, to be successfully transferred to underlying materials used for the fabrication of semiconductor devices.

Integrated circuits are chemically and physically integrated onto a substrate, such as a silicon substrate, by patterning conductive regions in the substrate and by patterning conductive and insulation layers over the substrate. The various conductive and insulation layer create uneven surfaces on a semiconductor structure. Interlevel dielectric (ILD) layers are formed between conductive layers (e.g., metal or polysilicon) in a semiconductor device or between conductive lines formed from the same conductive layer (in the same level). Contact holes are formed through the ILD layers to make electrical contact with conductive layers and device regions there below. A typical ILD stack of oxides is shown with reference to FIG. 1.

FIG. 1 is a diagram showing a prior art ILD based structure 100. The prior art ILD based structure 100 includes a first oxide layer 102 upon which a metal line 104 has been formed. Over these is formed a first film of conformal oxide 106. The first conformal oxide film 106 typically is formed using a plasma enhanced chemical vapor deposition (PECVD) process in order to deposit the film 106 such that it conforms to the topography on the surface of the wafer.

A second oxide film 108, which is also highly conformal, is deposited over the first conformal film 106 to fill any gaps between the metal lines 104. A cap-oxide layer 110, which is thicker than the other oxide layers, is deposited over the second oxide film 108. During a chemical mechanical polishing (CMP) process, most of the cap-oxide layer is removed or polished away. In particular, the process control is required to monitor the thickness of the cap-layer 110 and stop the CMP process at a predefined thickness.

In view of the foregoing, there is a need for systems and methods for efficiently polishing oxide layers during ILD CMP processes. The methods should provide fast and efficient removal of the cap-oxide layer to a predetermined thickness.

SUMMARY OF THE INVENTION

Broadly speaking, the present invention fills these needs by providing a two step polishing process having fast and slow removal rates, respectively. To increase accuracy during the first portion of the polishing process, embodiments of the present invention provide in-situ monitoring of the removal rate and thickness of a top wafer layer during planarization. In one embodiment, a method is disclosed for removing a top wafer layer during a CMP process. Time series data is collected based on a reflected wavelength from a top layer of a wafer. A frequency of peak intensities in the time series data is used to determine a removal rate of the top layer, and the removal rate is used to calculate a current thickness of the top layer. The CMP process is discontinued when the current thickness of the top layer is equal to or less than a target thickness, and a separate polishing process is performed to remove an additional portion of the top layer. The frequency can be determined by applying a Fourier Transform to the time series data. The Fourier Transform of the time series data can be analyzed to determine a peak magnitude in the frequency, which corresponds to the frequency of peak intensities in the time series data. The removal rate for top layer can be calculated based on the peak magnitude in the frequency, which can be used to calculate the current thickness of the top layer.

In another embodiment, a system is disclosed for removing a top wafer layer during a CMP process. The system includes a light source for illuminating a top layer of a wafer, and an optical detector for collecting time series data based on a reflected wavelength from the top layer. Further included in the system is logic that determines a removal rate of the top layer based on a frequency of peak intensities in the time series data, and logic that calculates a current thickness of top layer based on the removal rate. A process controller is also included that discontinues the CMP process when the current thickness of the top layer is equal to or less than a target thickness. Optionally, the system can include an endpoint detection subsystem that performs a separate polishing process to remove an additional portion of the top layer. As above, the logic can apply a Fourier Transform to the time series data to determine the frequency, which can be analyzed by addition logic to calculate a removal rate for top layer based on a peak magnitude in the frequency.

A further method for removing a top wafer layer during a CMP process is disclosed in another embodiment of the present invention. As above, time series data is collected based on a reflected wavelength from a top layer of a wafer. A Fourier Transform is applied to the time series data, and a frequency of peak intensities in the Fourier Transform of the time series data is analyzed to determine a peak magnitude in the frequency. A first removal rate of the top layer is determined based on the peak magnitude in the frequency, and a current thickness of top layer is calculated based on the first removal rate. The CMP process is discontinued when the current thickness of the top layer is equal to or less than a target thickness, and a separate polishing process is performed to remove an additional portion of the top layer. In one aspect, the separate polishing process can be based on a soft endpoint detection process having second removal rate that is lower than the first removal rate. Other aspects and advantages of the invention will become apparent from the following detailed description, taken in conjunction with the accompanying drawings, illustrating by way of example the principles of the invention.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE PREFERRED EMBODIMENTS

An invention is disclosed for in-situ monitoring of removal rate/thickness of a top layer during an ILD planarization process. To this end, embodiments of the present invention determine the removal rate of the top layer and perform a two step process for ILD planarization, which includes a fast removal rate process and a soft process with a lower removal rate. In the following description, numerous specific details are set forth in order to provide a thorough understanding of the present invention. It will be apparent, however, to one skilled in the art that the present invention may be practiced without some or all of these specific details. In other instances, well known process steps have not been described in detail in order not to unnecessarily obscure the present invention.

Figure 1:
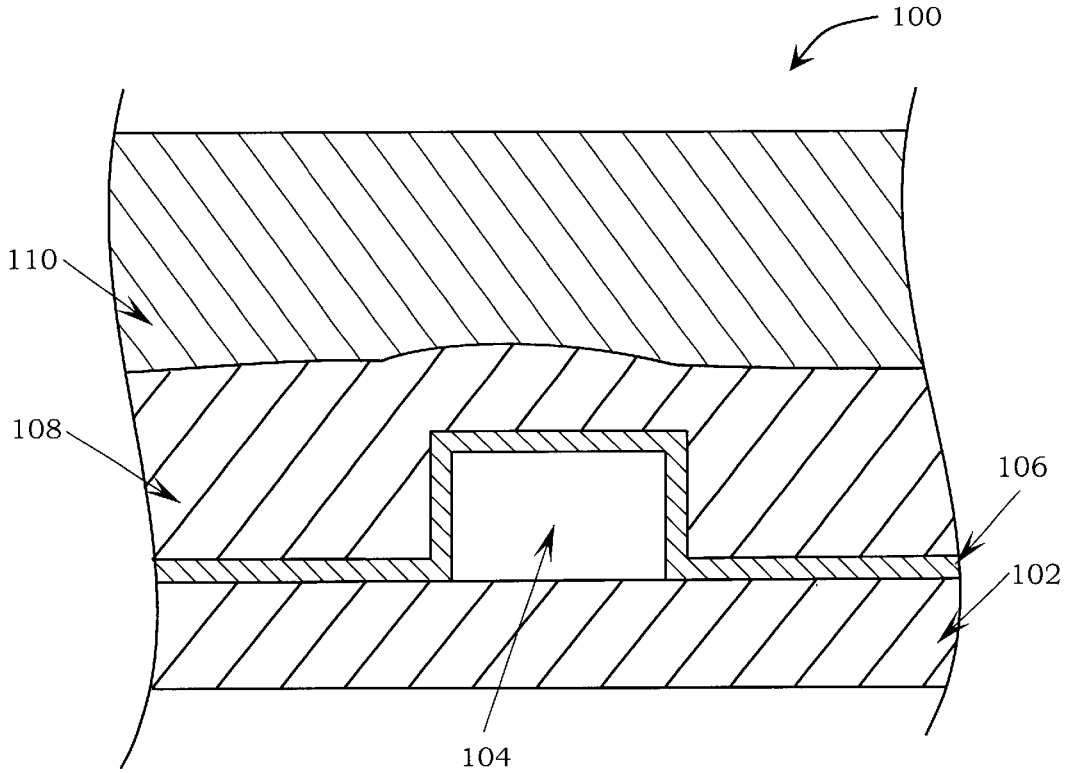
FIG. 1 (Prior Art)
FIG. 1 is a diagram showing a prior art ILD based structure.
Figure 2:
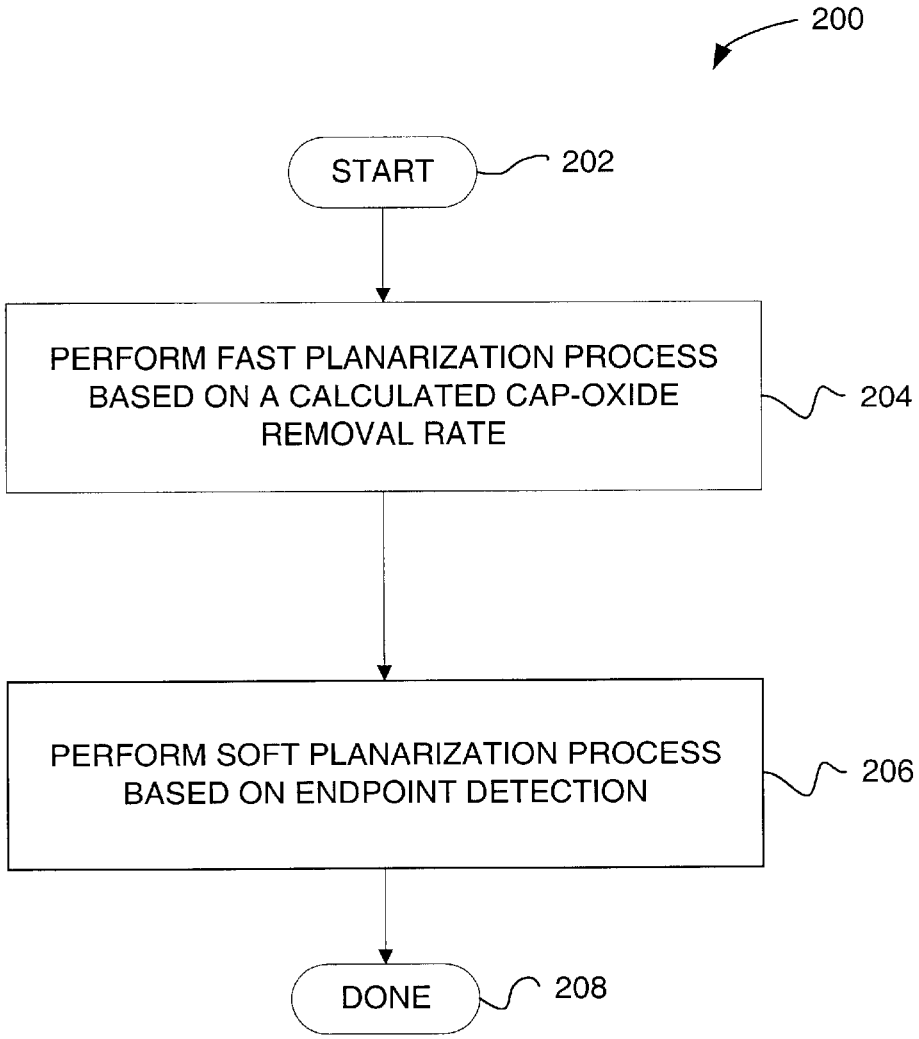
FIG. 2 is a flowchart showing a method for in-situ monitoring of removal rate and thickness of a top layer during ILD planarization, in accordance with an embodiment of the present invention.

FIG. 1 was described in terms of the prior art. FIG. 2 is a flowchart showing a method 200 for in-situ monitoring of removal rate and thickness of a top layer during ILD planarization, in accordance with an embodiment of the present invention. In an initial operation 202, preprocess operations are performed. Preprocess operations can include determining an initial thickness of the top layer, defining a target thickness, defining a final thickness, and other preprocess operations that will be apparent to those skilled in the art after a careful reading of the present disclosure.

In operation 204, a fast planarization process is performed based on a calculated cap-oxide removal rate. Embodiments of the present invention utilize a two-step process to polish the surface of a wafer. In the first step, operation 204, a fast process having a high removal rate is used to polish the cap-oxide layer to a predefined target thickness within a prescribed tolerance, as described next with reference to FIG. 3A.

Figure 3A:
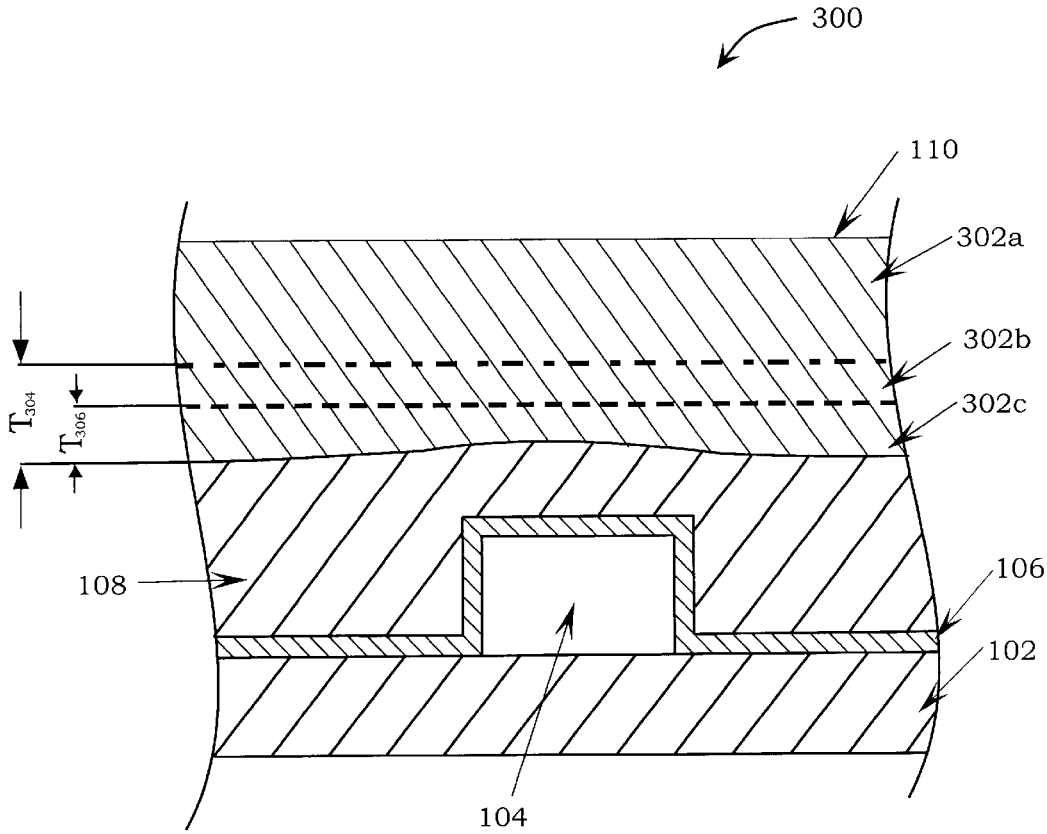
FIG. 3A is a diagram showing an ILD based structure polished in accordance with an embodiment of the present invention.

FIG. 3A is a diagram showing an ILD based structure 300 polished in accordance with an embodiment of the present invention. The ILD based structure 300 includes a first oxide layer 102 upon which a metal line 104 has been formed. Over these is formed a first film of conformal oxide 106. The first conformal oxide film 106 typically is formed using a PECVD process in order to deposit the film 106 such that it conforms to the topography on the surface of the wafer.

A second oxide film 108, which is also highly conformal, is deposited over the first conformal film 106 to fill any gaps between the metal lines 104. A cap-oxide layer 110, which is thicker than the other oxide layers, is deposited over the second oxide film 108. During a CMP process, most of the cap-oxide layer is removed or polished away. In particular, the process control is required to monitor the thickness of the cap-layer 110 and stop the CMP process at a predefined thickness. To increase production, embodiments of the present invention separate the process into two steps. The first step polishes the cap-oxide layer 110 down to a predetermined target thickness $T_{304}$ within a defined tolerance band, by polishing away a top portion 302*a* of the cap-oxide layer 110.

Referring back to FIG. 2, a soft planarization process is performed based on endpoint detection, in operation 206. As mentioned above, embodiments of the present invention utilize a two-step process to polish the surface of a wafer. In the second step, operation 206, a slow process having a low removal rate is used to polish the cap-oxide layer to a predefined final thickness.

Figure 3B:
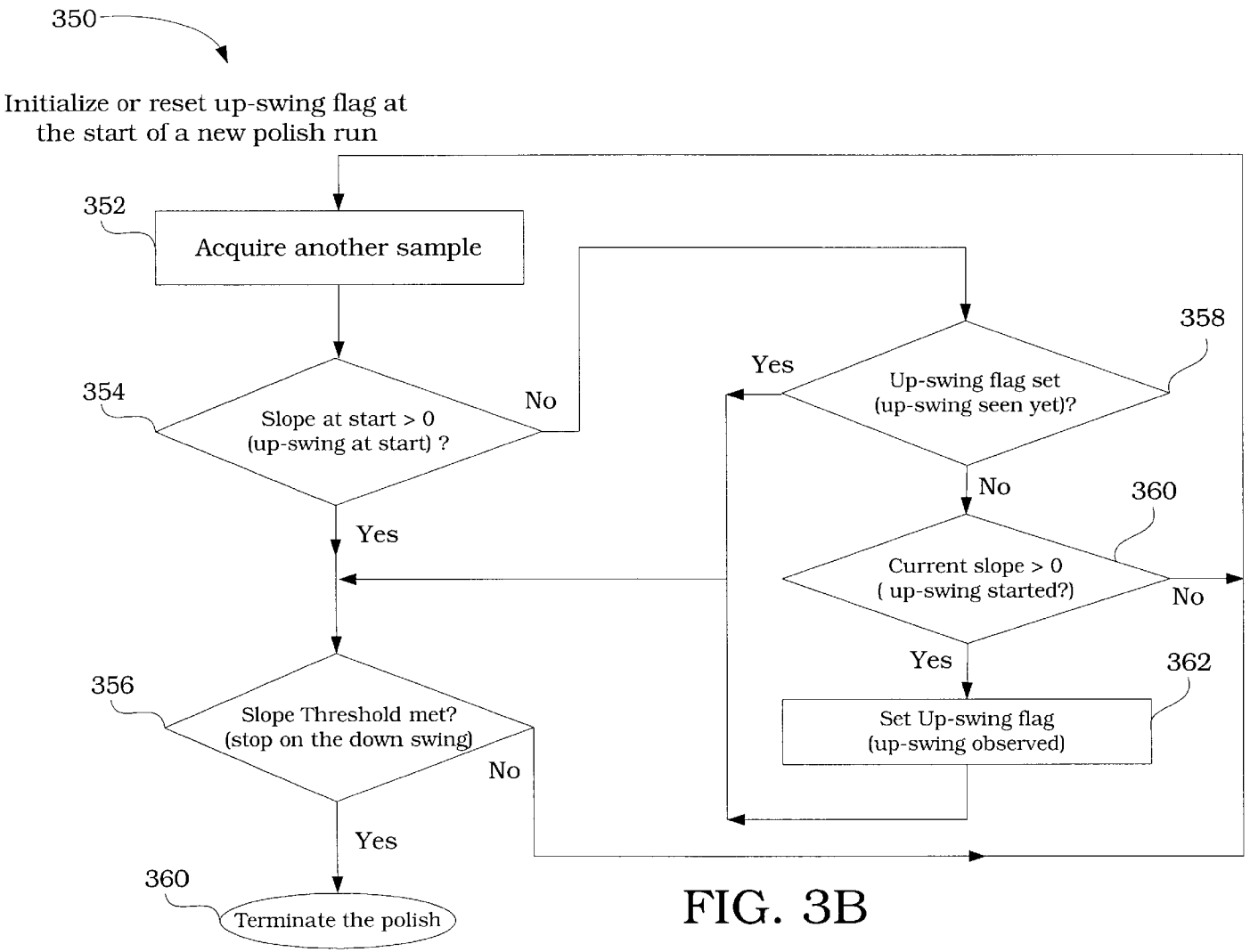
FIG. 3B is a flowchart showing an exemplary method for performing a soft planarization process based on endpoint detection, in accordance with an embodiment of the present invention.

FIG. 3B is a flowchart showing an exemplary method 350 for performing a soft planarization process based on endpoint detection, in accordance with an embodiment of the present invention. In one embodiment, the expected variations of incoming thickness at the second operation 206 in FIG. 2 is mean $\pm\lambda/4n$, where $\lambda$ is the probing wavelength used in the second step and n is the refractive index of the top layer. Hence, the first operation 204 in FIG. 2 generally should meet these criteria.

In operation 352, sample data is acquired using a probing wavelength that provides a trace characterized by cosine wave shifted by $\pi$ radians. Generally, the sample data is acquired by capturing reflectance data from a light source directed at the surface of the wafer. A decision is then made as to whether the slope of the trace is greater than zero, in operation 354. If the slope of the trace is greater than zero the method 350 continues to operation 356. Otherwise the method 350 branches to operation 358.

Figure 3C:
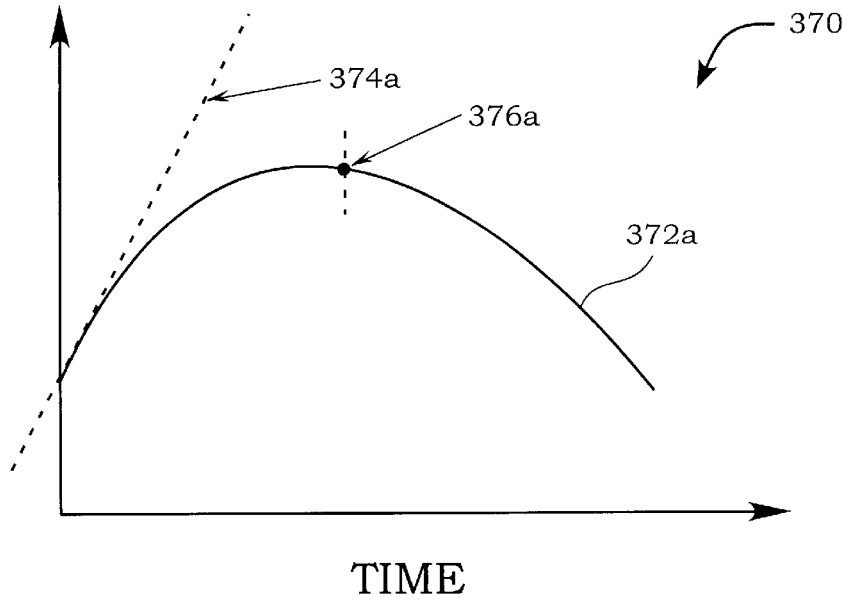
FIG. 3C is a graph showing a sample trace having an upswing at the start of the soft planarization process, in accordance with an embodiment of the present invention.

In operation 356, a decision is made as to whether a predefined slope threshold has been reached. When the slope of the trace is greater than zero, the trace has an upswing at the start of the soft planarization process. In this case, embodiments of the present invention stop the soft planarization process at an appropriate point on the down swing of the trace, which follows immediately after the upswing of the slope. FIG. 3C is a graph 370 showing a sample trace 372*a* having an upswing at the start of the soft planarization process, in accordance with an embodiment of the present invention. As shown in FIG. 3C, the slope 374*a* of the sample trace has an upward swing. As mentioned above, embodiments of the present invention stop the soft planarization process at an appropriate point on the down swing of the trace 372*a*, which follows immediately after the upswing of the slope 374*a*, for example, at point 376*a*. Hence, if the predefined slope threshold has been reached the method 350 terminates in operation 360. Otherwise, the method 350 continues with another data sample acquisition operation 352.

Referring back to operation 358 of FIG. 3B, a decision is made as to whether an upswing flag is set. Generally, embodiments of the present invention utilize an upswing flag to record whether an upswing in the slope has occurred. If the upswing flag is set, an upswing has already been detected and the method 350 continues with operation 356. Otherwise, an upswing has not been detected and the method 350 continues to operation 360.

Figure 3D:
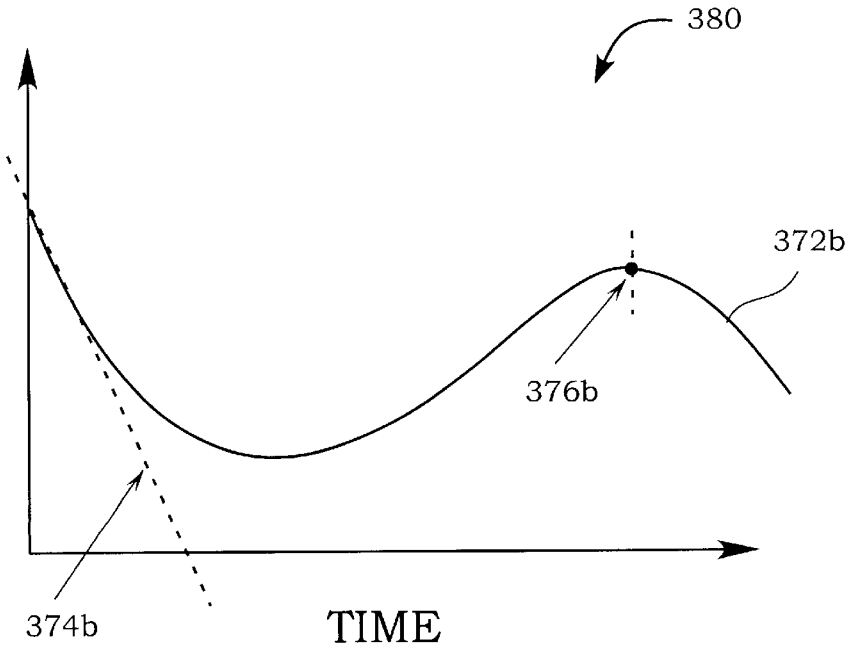
FIG. 3D is a graph showing a sample trace having a downswing at the start of the soft planarization process, in accordance with an embodiment of the present invention.

A decision is made as to whether the current slope of the trace is greater than zero, in operation 360. When operation 360 is first reached, a downward or horizontal slope has been detected in the trace. In this case, embodiments of the present invention wait until an upswing in the slope occurs. FIG. 3D is a graph 380 showing a sample trace 372*b* having a downswing at the start of the soft planarization process, in accordance with an embodiment of the present invention. As shown in FIG. 3D, the slope 374*b* of the sample trace has a downward swing. As explained below, embodiments of the present invention stop the soft planarization process at an appropriate point on the downswing of the trace 372*b*, which follows immediately after the upswing of the slope 374*b*, for example, at point 376*b*. Hence, if the current slope of the trace is not greater than zero, the method 350 continues with another sample acquisition operation 352. However, if the current slope of the trace is greater than zero, the method 350 continues to operation 362.

Referring back to FIG. 3B, the upswing flag is set in operation 362. As mentioned above, embodiments of the present invention utilize an upswing flag to record whether an upswing in the slope has occurred. As with operation 360, when operation 362 is first reached, a downward or horizontal slope has been detected in the trace. In this case, embodiments of the present invention wait until an upswing in the trace slope occurs and then terminate the soft planarization process when a downswing in the trace slop is detected after the upswing. Hence, after setting the upswing flag, in operation 362, the method 350 continues to operation 356, where the slop is compared to the slop threshold.

Turning to FIG. 3A, the slow planarization process is used to polish the remaining cap-oxide layer 110 down to a final thickness $T_{306}$, by polishing away a second portion 302*b* of the cap-oxide layer 110. If the thickness $T_{304}$ varies greatly at the beginning of operation 206, and in particular, which does not meet the tolerance requirement mentioned above, cycle aliasing can occur. As a result, false endpoints can be detected. However, using the embodiments of the present invention, the thickness at the beginning of operation 206 is known, namely the target thickness $T_{304}$. Thus, embodiments of the present invention avoid cycle aliasing and therefore can provide better control during the soft planarization process. In this manner, embodiments of the present invention polish the cap-oxide layer 110 allowing a final portion 302*c* of the cap-oxide layer 110 having a final thickness of $T_{306}$ to remain. However, it should be noted that embodiments of the present invention can be utilized to allow any thickness of the cap-oxide layer 110 to remain, including removing all the cap-oxide layer 110, resulting a no final portion 302*c* remaining after polishing.

Referring to FIG. 2, post process operations are performed in operation 208. Post process operations can include further ILD processing, further wafer etch, and other post process operations that will be apparent to those skilled in the art after a careful reading of the present description. Embodiments of the present invention can divide operations 204 and 206 between polishing stations, which can allow increased overall throughput. To remove the cap-oxide layer using a high removal rate, embodiments of the present invention monitor, in real-time, the removal rate and compute the thickness of the cap-oxide layer, as described in greater detail next with reference to FIG. 4.

Figure 4:
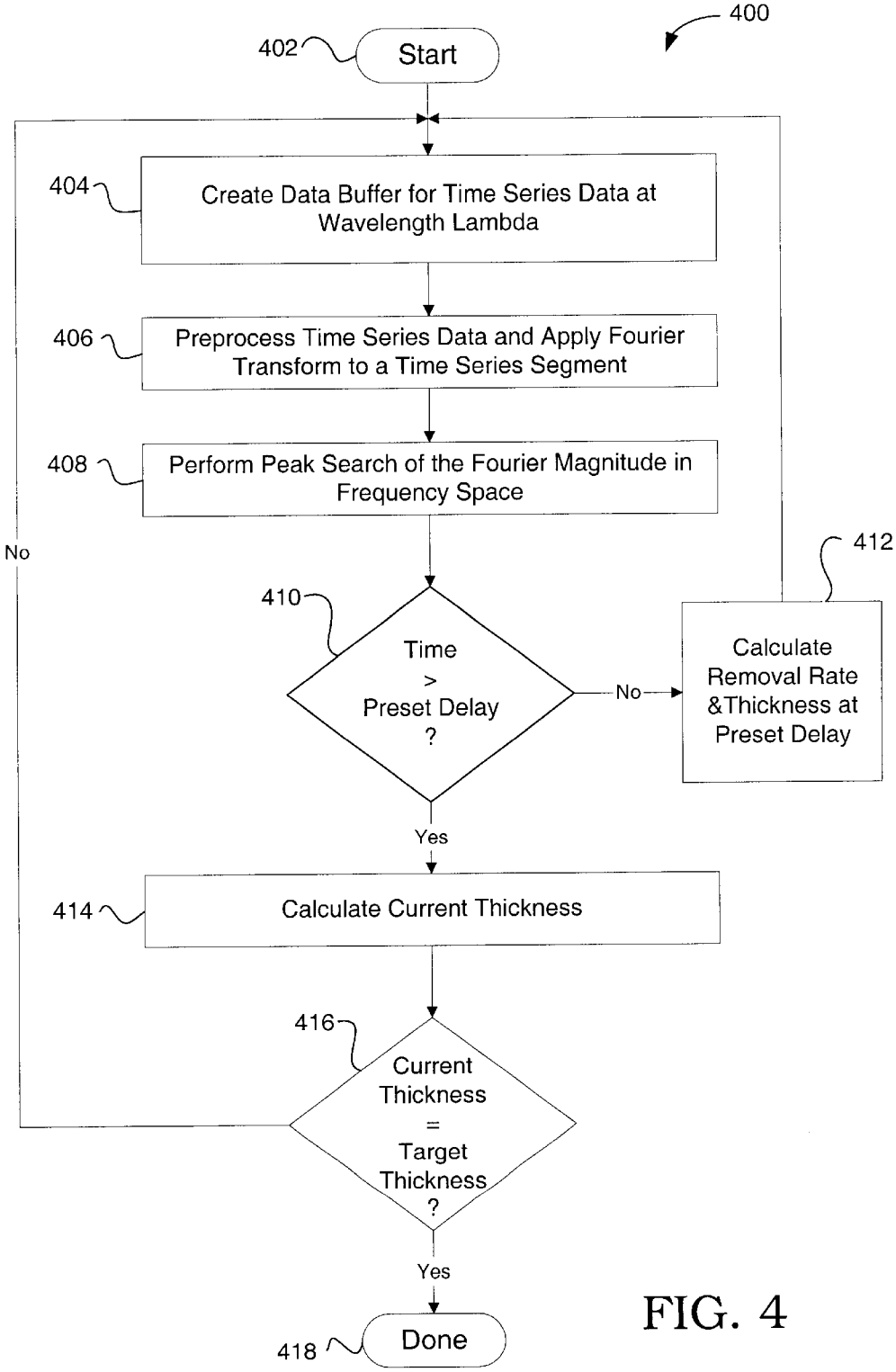
FIG. 4 is flowchart showing a method for in-situ monitoring of removal rate and thickness of a top layer during a high removal rate ILD planarization process, in accordance with an embodiment of the present invention.

FIG. 4 is flowchart showing a method 400 for in-situ monitoring of removal rate and thickness of a top layer during a high removal rate ILD planarization process, in accordance with an embodiment of the present invention. In an initial operation 402, preprocess operations are performed. Preprocess operations can include determining an initial thickness of the top layer, defining a target thickness, and other preprocess operations that will be apparent to those skilled in the art after a careful reading of the present disclosure.

In operation 404, a data buffer is created for time series data at a particular wavelength $\lambda$. Embodiments of the present invention utilize a reflectometery apparatus, for example a broad band reflectometery apparatus to capture time series data. Specifically, a fiber bundle periodically carries a pulse, or flash, of white light from a lamp source and delivers the flash to the surface of a wafer through an opening of the polishing belt using a triggering mechanism. Reflected light from the wafer is then collected and passed through a further fiber bundle to a spectrometer, which disperses the reflected light into various wavelength components. The intensity at each wavelength is then digitized and delivered to an on-board computer for further processing.

Figure 5A:
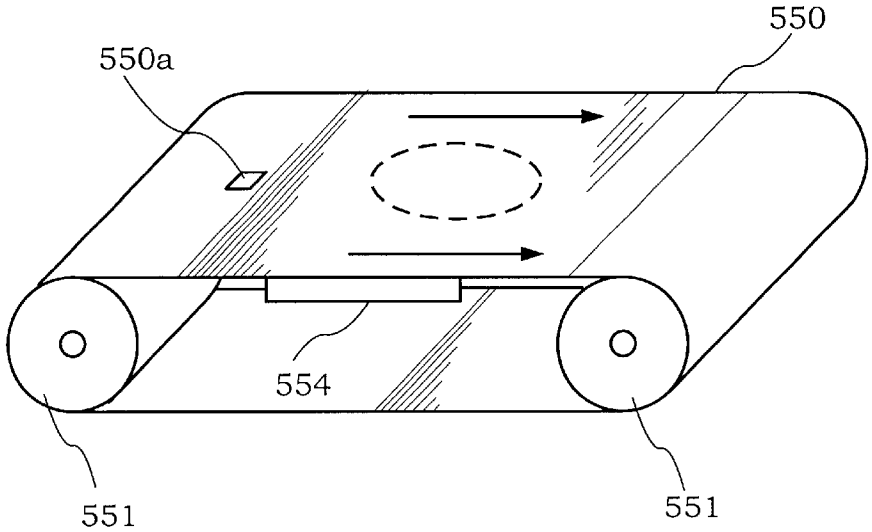
FIG. 5A shows a CMP system in which a pad is designed to rotate around rollers, in accordance with an embodiment of the present invention.
Figure 5B:
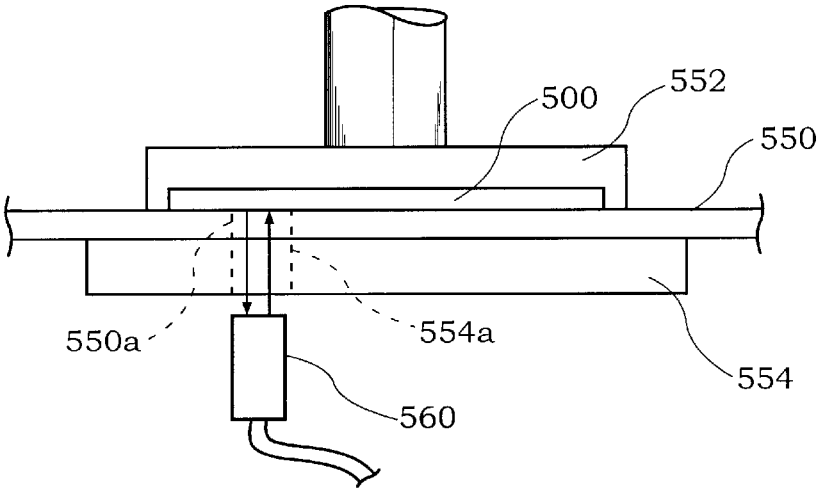
FIG. 5B is an illustration showing an endpoint detection system, in accordance with an embodiment of the present invention.

For example, FIG. 5A shows a CMP system in which a pad 550 is designed to rotate around rollers 551, in accordance with an embodiment of the present invention. A platen 554 is positioned under the pad 550 to provide a surface onto which a wafer will be applied using a carrier 552. Time series data is obtained using an optical detector 560 in which light is applied through the platen 554, through the pad 550 and onto the surface of the wafer 500 being polished, as shown FIG. 5B. In order to apply light to the wafer, a pad slot 550*a* is formed into the pad 550. In some embodiments, the pad 550 may include a number of pad slots 550*a* strategically placed in different locations of the pad 550. Typically, the pad slots 550*a* are designed small enough to minimize the impact on the polishing operation. In addition to the pad slot 550*a*, a platen slot 554*a* is defined in the platen 554. The platen slot 554*a* is designed to allow the broad band optical beam to be passed through the platen 554, through the pad 550, and onto the desired surface of the wafer 500 during polishing.

Figure 6:
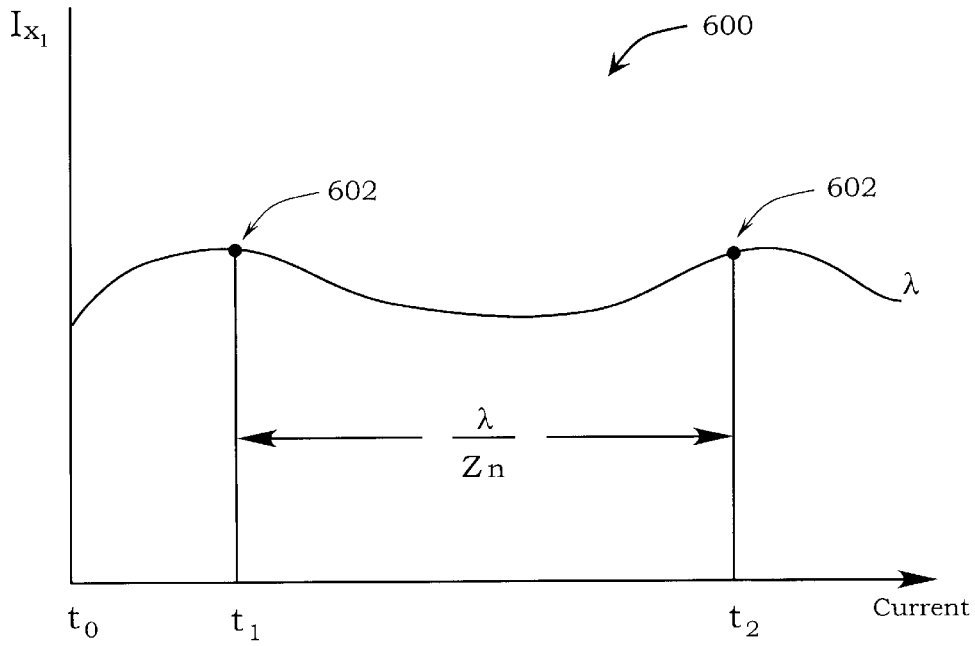
FIG. 6 is an intensity graph 600 showing the intensity of a single wavelength $\lambda$ as a function of time, in accordance with an embodiment of the present invention.

FIG. 6 is an intensity graph 600 showing the intensity of a single wavelength $\lambda$ as a function of time, in accordance with an embodiment of the present invention. As illustrated in FIG. 6, the intensity at wavelength $\lambda$ varies over time as a result of changing optical interference caused by layer thickness changes. Specifically, at particular thicknesses constructive optical interference occurs creating peaks 602 in the intensity graph 600 of wavelength $\lambda$, and at other thicknesses destructive optical interference occurs creating valleys in the intensity graph 600 of wavelength λ. Hence, to a first order approximation, assuming no contribution from a patterned surface, the time variation of the reflected wave at wavelength λ as the thickness of the top layer decreases do to polishing is described by the following equation:

$$R(t)=r_A+r_B e_0^{-i\cdot 2(d-r\cdot t)n\cdot 2\pi/\lambda}, \quad (1)$$

where $r_A$ is a constant bias and $r_B$ is a scaling factor, both of which are determined as products of Fresnel's coefficients. In addition, r is the removal rate of the cap-oxide layer as the polishing proceeds, and $d_0$ is the initial thickness of the cap-oxide layer. As can be seen from the intensity graph 600, the reflectance at a given wavelength λ is approximately sinusoidal in time of monotone frequency. However, it should be noted that complex patterned structures can result in signals with multiple sinusoidals.

The amount of oxide removed during a particular time period can be determined by examining the peaks 602 in the intensity graph 600. The interval between the peaks in the intensity graph 600 represents a cycle. In particular, the amount of oxide removed during a single cycle, which is the time period between time $t_1$ and time $t_2$, is given by the following equation:

$$\text{Thickness_removed/cycle}=\lambda/2n \text{ Å}, \quad (2)$$

where λ is the probing wavelength and n is the refractive index. To determine the removal rate of the cap-oxide, the Thickness removed per cycle determined in equation (2) above can be divided by $t_2-t_1$, which is the time period of the cycle. To ensure adequate data is acquired to perform the removal rate calculation, calculations are delayed by a preset delay, during which thickness calculations are not performed. The preset delay time ensures that at least one cycle of the time series data is acquired before a reliable estimation of the removal rate is performed.

Although the two peak analysis technique discussed above can be used to determine the removal rate, it can be subject to errors caused by noise and other unwanted interference occurring during the data capturing process. Hence, embodiments of the present invention utilize a large number of peaks 602 to determine the removal rate of the cap-oxide. In particular, embodiments of the present invention utilize a Fourier Transform to facilitate calculation of the removal rate of the cap-oxide, as described next with reference to FIG. 4.

Hence, the time series data is preprocessed and a Fourier Transform is applied to the time series data, in operation 406. Embodiments of the present invention estimate the real-time frequency of the time series data and extract the removal rate from the estimated frequency. To achieve this, a discrete Fourier Transform is applied at each time step to the data segment available at that time. Essentially, the discrete Fourier Transform maps the time domain, illustrated in FIG. 6, to frequency space.

Figure 7:
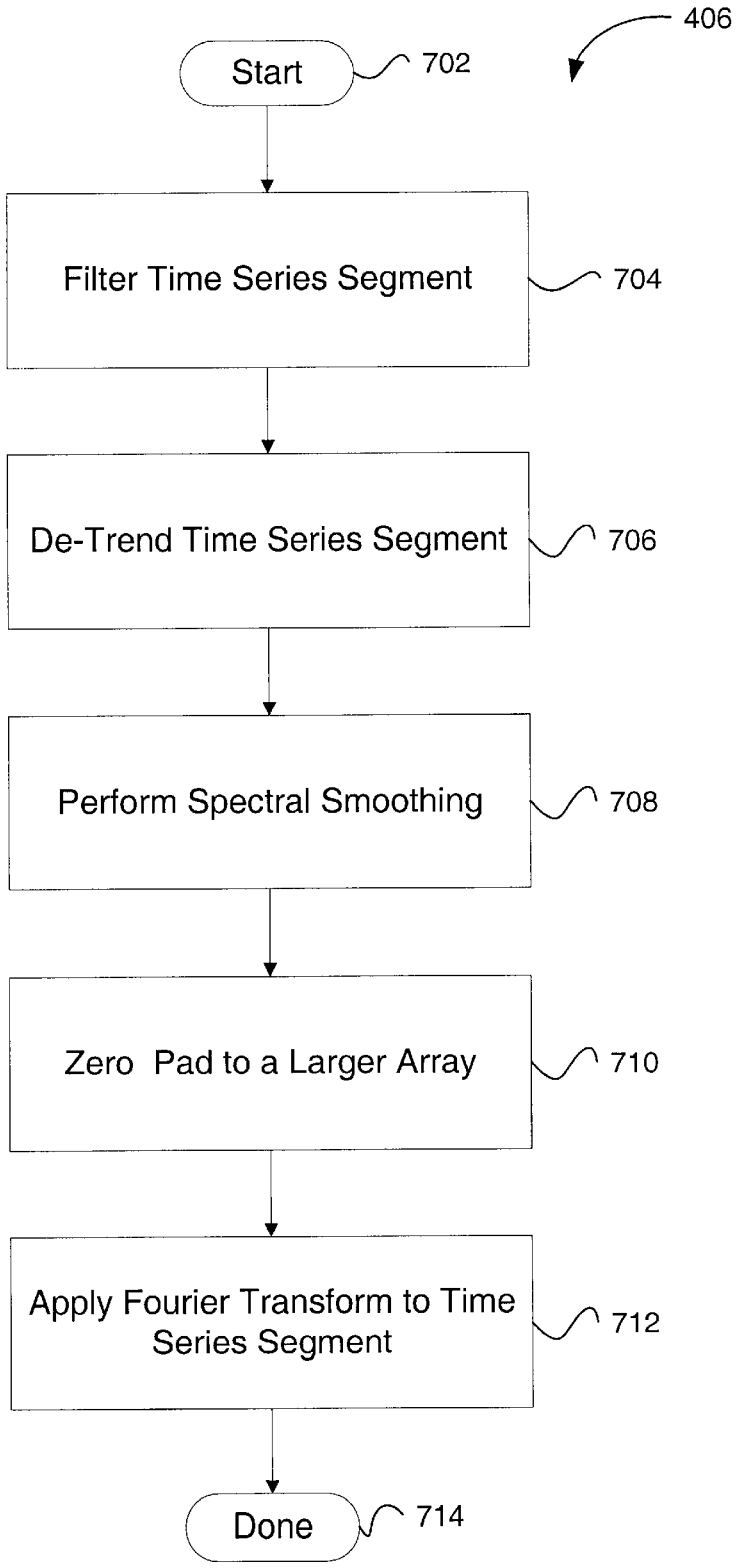
FIG. 7 is flowchart showing a method for preprocessing and applying a Fourier Transform to the time series data, in accordance with an embodiment of the present invention.

FIG. 7 is flowchart showing a method 700 for preprocessing and applying a Fourier Transform to the time series data, in accordance with an embodiment of the present invention. In an initial operation 702, preprocess operations are performed. Preprocess operations can include determining an initial thickness of the cap-oxide layer, obtaining time series data, and other preprocess operations that will be apparent to those skilled in the art after a careful reading of the present disclosure.

In operation 704, the time series segment is filtered. During the polishing process, light transmission through a dirty medium consisting of slurry and other optical path variations can cause sample to sample variations. To reduce these sample to sample variations, embodiments of the present invention filter the time series segment data. In one embodiment, a moving average filter is used to reduce noise occurring in the optical data.

The time series data is de-trended in operation 706. Specifically, a quadratic curve is fitted to the time series data segment and subtracted from the signal to remove any linear or quadratic behavior in the data segment. De-trending stretches out the time series data curve by fitting a polynomial to the time series data curve and then subtracting out the polynomial. In this manner, the time series data curve begins essentially flat, thus allowing for easier detection of peaks during Fourier Transform.

In operation 708, spectral smoothing is applied to the time series data. Spectral smoothing reduces spectral leakage introduced by discontinuities at the edges of the time series segment, which generally occur when the reflected time series data contains a non-integer number of cycles or oscillations. Zero padding is then applied to the time series data in operation 710. Zero padding of the time series data helps to zoom the Fourier Transform onto a higher resolution grid. This procedure essentially does an interpolation of the Fourier Transform on to a finer grid. This, in turn, enables increased accuracy in peak detection. In one embodiment, Zero padding is performed by extending the number of discrete pixels of the reflected spectrum to a much larger grid. Any pixels in the extended grid not covered by the actual acquired data are can be filled with a value of zero.

Figure 8:
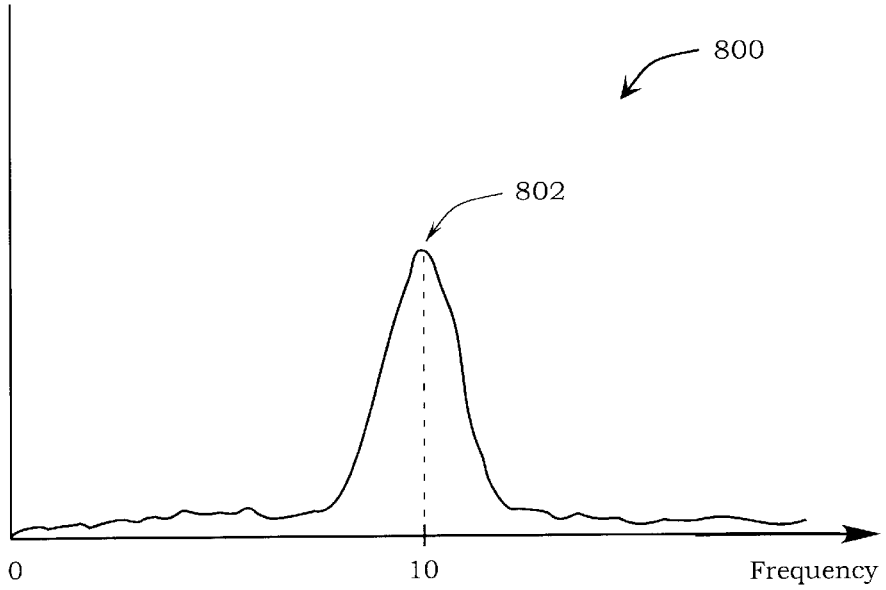
FIG. 8 is a frequency graph showing the intensity as a function of cycle frequency, in accordance with an embodiment of the present invention.

In operation 712, a Fourier Transform is applied to the Time series Segment. A mentioned above, embodiments of the present invention estimate the real-time frequency of the time series data and extract the removal rate for the cap-oxide from the estimated the real-time frequency. To estimate the frequency, a discrete Fourier Transform is applied to the data segment at each time step. The discrete Fourier Transform maps the time domain signal to the frequency space. FIG. 8 is a frequency graph 800 showing the intensity as a function of cycle frequency, in accordance with an embodiment of the present invention. The frequency graph 800 maps the intensity shown in FIG. 6 to the frequency space. Thus, the intensity of the time series data at wavelength λ is shown as a function of the cycle frequency.

Referring back to FIG. 4, a peak search of the Fourier magnitude in frequency space is performed in operation 408. Turning to FIG. 8, embodiments of the present invention examine the frequency graph 800 to determine at what frequency the peak intensity magnitude 802 occurs. The peak intensity magnitude 802 indicates the frequency of the peaks 602 in the intensity graph 600 of FIG. 6. As described in greater detail subsequently, the embodiments of the present invention utilize the peak intensity magnitude 802 to determine the removal rate of the cap-oxide in a robust manner.

Turning back to FIG. 4, a decision is then made as to whether the current process time is greater than the preset delay, in operation 410. As mentioned above, removal rate calculations are delayed until a predetermined amount of time series data is obtained over a preset delay period. Once the preset delay has been reached, the time series data is preprocessed, a Fourier Transform is applied, and peak search is performed in the Fourier generated frequency space. Hence, in operation 410, if the current process time is equal to the preset delay, the method 400 estimates the amount of cap-oxide removed during the preset delay period in operation 412. Otherwise, the method 400 calculates the current thickness based on the current removal rate in operation 414.

In operation 412, the amount of cap-oxide removed during the preset delay period is calculated. As mentioned above, a preset delay is utilized to ensure at least one cycle of the time series data is acquired before an estimation of the removal rate is performed. Since the thickness of the cap-oxide layer is unknown at the preset delay time, embodiments of the present invention estimate the thickness of the cap-oxide layer by extrapolating backwards in time based on a removal rate computed at the present delay time using the following equation:

$$d(t_{preset_delay})=d_0-r(t_{preset_delay})\cdot t_{preset_delay}, \quad (3)$$

where $d(t_{preset_delay})$ is the thickness at the preset delay time, $d_0$ is the initial thickness of the cap-oxide layer, $t_{preset_delay}$ is the preset delay time, and $r(t_{preset_delay})$ is the removal rate at the preset delay time, as illustrated next in FIG. 9.

Figure 9:
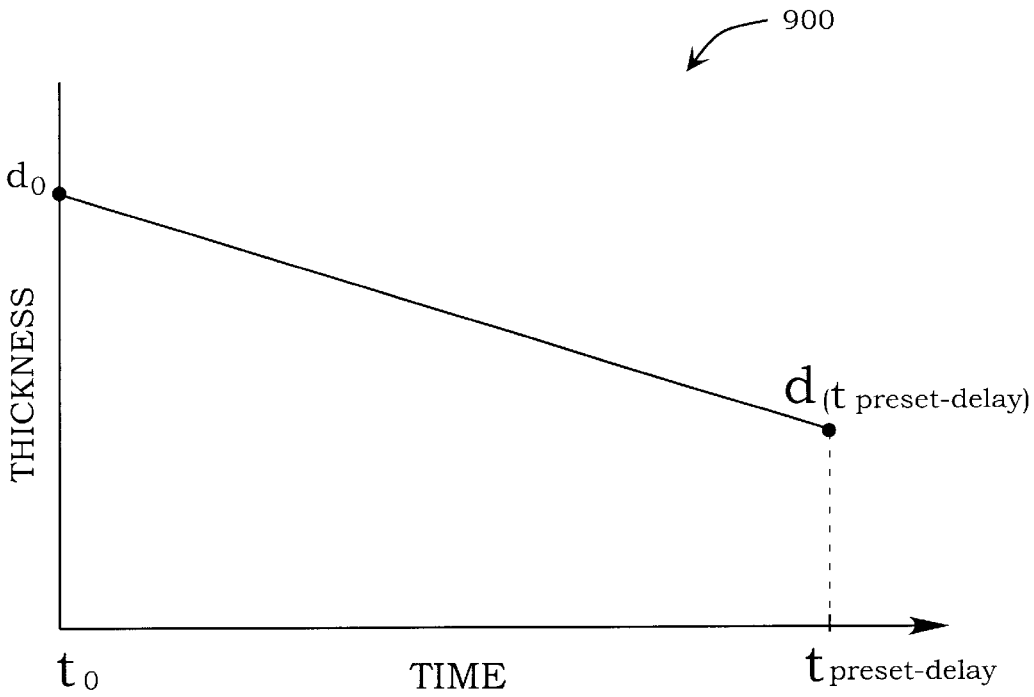
FIG. 9 is an estimated thickness graph, in accordance with an embodiment of the present invention.

FIG. 9 is an estimated thickness graph 900, in accordance with an embodiment of the present invention. The estimated thickness graph 900 shows the thickness of the cap-oxide layer as a function of time. In particular, the estimated thickness graph 900 shows the thickness of the cap-oxide layer between initial time to and the preset delay time $t_{preset_delay}$. Embodiments of the present invention calculate the removal rate at time $t_{preset_delay}$ using the Fourier Transform peak analysis. In particular, the frequency of the time series is determined by analyzing the magnitude peak of the Fourier Transform graph, as described previously with reference to FIG. 8. For example, in FIG. 8, the peak intensity magnitude 802 indicates the frequency of the peaks 602 in the intensity graph 600 of FIG. 6. Hence, in the example of FIG. 8, the peak magnitude frequency 802 of the peaks in time series data is 10 cycles per second. The removal rate at time $t_{preset_delay}$ can then be determined using the following equation:

$$r(t_{preset_delay})=\text{frequency}\cdot(\lambda/2n), \quad (4)$$

where $r(t_{preset_delay})$ is the removal rate at the preset delay time, frequency is the frequency of the peaks in the time series data, $\lambda$ is the probing wavelength, and n is the refractive index. The thickness at time $t_{preset_delay}$ can then be estimated by assuming that the removal rate during the time period from $t_0$ to $t_{preset_delay}$ is $r(t_{preset_delay})$. Thus, the embodiments of the present invention estimate the thickness at time $t_{preset_delay}$ by multiplying the removal rate at the preset delay time by the preset delay time and subtracting the product from the initial thickness, as shown in equation (3) above. It should be noted that initial thickness information can be obtained using an inline metrology tool. Referring back to FIG. 4, the method 400 continues to collect time series data in operation 404 after calculating the amount of cap-oxide removed during the preset delay period in operation 412.

In operation 414, the current thickness is calculated based on the current removal rate. Once the thickness at time $t_{preset_delay}$ has been calculated, the method 400 branches to operation 414, where the current thickness is calculated based on the current removal rate and the previous estimate of thickness iteratively. In particular, the top layer is initialized to $d(t_{preset_delay})$, as follows:

$$\text{Current_thickness}_{initial}=d(t_{preset_delay}), \quad (5)$$

where $d(t_{preset_delay})$ is the thickness at the preset delay time. Then, at any later point in time the current thickness can be determined as follows:

$$\text{Current_thickness}=d_{previous_estimate}-(r_{previous_estimate}\cdot\text{sampling interval}), \quad (6)$$

where $d_{previous_estimate}$ is the previous thickness estimate, and r is the current estimate of the removal rate. A decision is then made as to whether the current thickness is equal to the target thickness, in operation 416. As mentioned previously with respect to FIG. 2, embodiments of the present invention utilize a fast polishing process based on the cap-oxide removal rate before transferring the wafer to a soft process based on endpoint detection. As illustrated in FIG. 3, the first step polishes the cap-oxide layer 110 down to a predetermined target thickness $T_{304}$, by polishing away a top portion 302*a* of the cap-oxide layer 110. Referring back to FIG. 4, if the current thickness is equal to the target thickness, the method 400 is completed in operation 418. Otherwise, the method 400 continues to collect time series data in operation 404.

Post process operations are performed in operation 418. Post process operations can include performing a soft polishing process based on endpoint detection, further wafer processing, and other post process operations that will be apparent to those skilled in the art after a careful reading of the present description. In this manner, the embodiments of the present invention can provide efficient polishing of oxide layers during ILD CMP planarization.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A method for removing a top wafer layer during a chemical mechanical polishing (CMP) process, comprising the operations of:

collecting time series data based on a reflected wavelength from a top layer of a wafer;

determining a removal rate of the top layer based on a frequency of peak intensities in the time series data;

calculating a current thickness of the top layer based on the removal rate;

discontinuing the CMP process when the current thickness of the top layer is equal to or less than a target thickness; and performing a separate polishing process to remove an additional portion of the top layer.

2. A method as recited in claim 1, wherein the top layer is an oxide layer.

3. A method as recited in claim 1, wherein the frequency is determined by applying a Fourier Transform to the time series data.

4. A method as recited in claim 3, further comprising the operation of analyzing the Fourier Transform to the time series data to determine a peak magnitude in the frequency.

5. A method as recited in claim 4, wherein the peak magnitude in the frequency corresponds to the frequency of peak intensities in the time series data.

6. A method as recited in claim 5, further comprising the operation of calculating a removal rate for top layer based on the peak magnitude in the frequency.

7. A method as recited in claim 6, wherein the current thickness is calculated based on the calculated removal rate.

8. A system for removing a top wafer layer during a chemical mechanical polishing (CMP) process, comprising:

a light source for illuminating a top layer of a wafer;

an optical detector for collecting time series data based on a reflected wavelength from the top layer;

computer program instructions that determines a removal rate of the top layer based on a frequency of peak intensities in the time series data;

computer program instructions that calculates a current thickness of top layer based on the removal rate;

a process controller that discontinues the CMP process when the current thickness of the top layer is equal to or less than a target thickness; and an endpoint detection subsystem that performs a separate polishing process to remove an additional portion of the top layer.

9. A system as recited in claim 8, wherein the top layer is an oxide layer.

10. A system as recited in claim 8, wherein the frequency is determined by applying a Fourier Transform to the time series data.

11. A system as recited in claim 10, further comprising computer program instructions that analyzes the frequency to determine a peak magnitude in the frequency.

12. A system as recited in claim 11, wherein the peak magnitude in the frequency corresponds to the frequency of peak intensities in the time series data.

13. A system as recited in claim 12, further comprising computer program instructions that calculates a removal rate for the top layer based on the peak magnitude in the frequency.

14. A system as recited in claim 13, wherein the current thickness is calculated based on the calculated removal rate.

15. A method for removing a top wafer layer during a chemical mechanical polishing (CMP) process, comprising the operations of:

collecting time series data based on a reflected wavelength from a top layer of a wafer;

applying a Fourier Transform to the time series data;

analyzing a frequency of peak intensities in the Fourier Transform of the time series data to determine a peak magnitude in the frequency;

determining a first removal rate o f the top layer based on the peak magnitude in the frequency;

calculating a current thickness of top layer based on the first removal rate;

discontinuing the CMP process when the current thickness of the top layer is equal to or less than a target thickness; and performing a separate polishing process to remove an additional portion of the top layer.

16. A method as recited in claim 15, wherein the top layer is an oxide layer.

17. A method as recited in claim 16, wherein the CMP process occurs during interlayer dielectric (ILD) planarization.

18. A method as recited in claim 17, wherein the separate polishing process is based on a soft endpoint detection process having second removal rate lower than the first removal rate.

* * * * *